US008759649B2

(12) United States Patent
Potyrala

(10) Patent No.: US 8,759,649 B2
(45) Date of Patent: Jun. 24, 2014

(54) TUBULAR METAL NECK FOR STRINGED MUSICAL INSTRUMENTS

(71) Applicant: Stanislaw Potyrala, Mississauga (CA)

(72) Inventor: Stanislaw Potyrala, Mississauga (CA)

( * ) Notice: Subject to any disclaimer, the term of this patent is extended or adjusted under 35 U.S.C. 154(b) by 0 days.

(21) Appl. No.: 13/872,095

(22) Filed: Apr. 27, 2013

(65) Prior Publication Data

US 2013/0291704 A1 Nov. 7, 2013

Related U.S. Application Data

(60) Provisional application No. 61/641,867, filed on May 2, 2012.

(51) Int. Cl.
*G10D 3/00* (2006.01)
*G10D 3/06* (2006.01)

(52) U.S. Cl.
CPC ..... *G10D 3/06* (2013.01)
USPC ..... 84/293

(58) Field of Classification Search
CPC ..... G10D 3/06
USPC ..... 84/293
See application file for complete search history.

(56) References Cited

U.S. PATENT DOCUMENTS

| | | | | | |
|---|---|---|---|---|---|
| 375,224 | A * | 12/1887 | Talbott | 84/291 |
| 549,966 | A * | 11/1895 | Hutchins | 84/292 |
| 977,127 | A * | 11/1910 | Rengert et al. | 84/293 |
| 1,304,914 | A * | 5/1919 | Smith | 84/291 |
| 1,652,627 | A * | 12/1927 | Jerome | 84/269 |
| 2,113,446 | A * | 4/1938 | Gugino | 84/293 |
| 3,481,238 | A * | 12/1969 | Veres | 84/267 |
| 3,915,049 | A * | 10/1975 | Bean | 84/743 |
| 4,064,780 | A * | 12/1977 | Bond | 84/314 R |
| 4,121,492 | A * | 10/1978 | Berardi et al. | 84/293 |
| 4,145,948 | A * | 3/1979 | Turner | 84/293 |
| 4,189,974 | A * | 2/1980 | Martin et al. | 84/293 |
| 4,200,023 | A * | 4/1980 | Kaman | 84/293 |
| 4,359,924 | A * | 11/1982 | Brunet | 84/293 |
| 4,481,856 | A * | 11/1984 | Grawi | 84/173 |
| 4,765,219 | A * | 8/1988 | Alm | 84/726 |
| 5,337,643 | A * | 8/1994 | Cantrell | 84/293 |
| 5,537,906 | A * | 7/1996 | Steinberger | 84/291 |
| 5,753,837 | A * | 5/1998 | Petillo et al. | 84/293 |
| 6,005,173 | A * | 12/1999 | Mitchell | 84/291 |
| 6,777,608 | B1 * | 8/2004 | Redding | 84/746 |
| 7,531,729 | B1 * | 5/2009 | Davis et al. | 84/293 |
| 7,659,464 | B1 * | 2/2010 | Kokodis | 84/293 |
| 7,763,784 | B2 * | 7/2010 | Luttwak | 84/291 |
| 7,763,786 | B2 * | 7/2010 | Jones et al. | 84/314 R |
| 8,324,489 | B1 * | 12/2012 | Chapman | 84/314 R |
| 2013/0174709 | A1 * | 7/2013 | DeLong et al. | 84/267 |
| 2013/0291704 | A1 * | 11/2013 | Potyrala | 84/293 |

* cited by examiner

*Primary Examiner* — Robert W Horn

(57) ABSTRACT

This invention pertains to the neck for a stringed electronic musical instrument that is constructed of a pipe made of a steel alloy. The instrument has superior sound qualities, has optimal ergonomic properties that fit the natural grip of the human hand, maintains tune under conditions of environmental extremes and mechanical stress, and can be easily manufactured with a high degree of precision and accuracy on a mass scale.

14 Claims, 7 Drawing Sheets

TUBULAR METAL NECK FOR STRINGED MUSICAL INSTRUMENTS

BACKGROUND OF THE INVENTION

Fine electric guitars made of wood and wood composites that have excellent acoustic qualities have been made for over half a century. Guitars of this type tend to be made by artisans who have assimilated the knowledge accumulated over the years by trial and error. Frequently exotic woods are used to achieve high fidelity. In order to compensate for warping and dimensional changes due to alterations in temperature and humidity, laminates are used in an attempt to correct for these effects. The lack of stiffness and strength of wood under constant tension from the strings and exposed to other forms of mechanical stress and impacts has been a problem, partially addressed by the use of metal truss rods. Mechanical accuracy is difficult to achieve and maintain. Wood instruments require continuous retuning to compensate for these effects. No two guitars will have exactly the same sound and tuning properties using this approach.

Improvements suggesting the use of metals, most prominently aluminum and composites made of carbon fiber and plastics have developed over the years to address the deficiencies in the structural properties of wood and attempt to alter and improve the acoustic properties. An improvement in the resistance to dimensional changes in response to humidity was achieved using these new materials. The use of aluminum to control thermal expansion and contraction is problematic as the thermal conductivity is high causing it to expand and contract quickly in response to changes in temperature and alter the tune. This is exacerbated by using different metals for the acoustic elements such as stainless steel strings that have a much slower response to temperature changes than aluminum and large differences in their thermal expansion coefficients. Aluminum and graphite based neck structures do not closely match the strings with respect to either their resonate properties or their in their response to temperature changes.

The light weight of aluminum and graphite and the ability to either extrude or mold complex shapes led to many different variations on the theme of a guitar neck. Various types of open channels in the neck were designed to lower the weight and to provide conduits to transfer the vibrations of the strings to the electronic pick-ups. Convex and concave channels were added in an attempt to improve the grip of the hand (U.S. Pat. No. 5,337,643). Frets and fret boards were attached to the neck by bonding, bolting, welding, or press fitting different materials (U.S. Pat. No. 4,189,974), in some instances creating a different material on the aluminum surface by introducing oxide surfaces with an anodizing process (US 201020266734 A1). Enclosing the channels with the fret boards of different materials from the neck to create channel shaped tubular structures (U.S. Pat. No. 3,915,049; U.S. Pat. No. 4,145,948; U.S. Pat. No. 4,359,924) were also described. Other times the channels and grooves were left open to the air (U.S. Pat. Nos. 3,915,049; 4,189,974; 5,337,643; US APP 20120266734). The creation of a channel shape gave the neck the mechanical characteristics of a beam which was noted to add to the inherent strength of the structure allowing the use of thinner walls, lighter weight, and eliminate the truss rod.

As is the case with the development of any devises over periods of time and much iteration, some historical design characteristics can persist, for better or worse. Examples abound in all fields from tools (slotted screw drivers) to transportation (spacing of railroad rails dates back to ruts created by Roman chariots in the major roads of Europe), to communications and computers (Ctrl-Alt-Delete). The flat or slightly curved surface of the finger and fret board of a guitar is an example of a fundamental design principle that has been passed down through the ages and appears on all guitars made today.

The shape of the fret and fret boards of these aluminum and graphite based necks has remained substantially unchanged from their wooden counterparts as did the material of the strings, primarily steel or brass wrapped steel. Fret boards continued to have a long radius of curvature, typically greater than 10 inches, or remained flat resulting in a radius of curvature of infinite dimensions. The geometries of the front of the neck, where the strings lie, and the back of the neck, where the palm of the hand rests, remain substantially dissimilar for reasons that are not immediately obvious other than historical precedence and general familiarity with a particular feel that develops with a musician with many hours of practice. We propose a different design that has better ergonomic properties and a substantially different feel than current state of the art.

In order to maintain the different geometry of the front and back of the neck and its associated functional elements, the frets and fret boards have been generally constructed from multiple parts, frequently of dissimilar materials having different acoustic properties. This requires the use of glues and fasteners of various ilk's which should not be viewed as advantageous as they can only inhibit the transfer of vibrations with high fidelity resulting in sound deadening effects. In addition this complicates manufacture and compromises the achieving of precision and accuracy on a routine basis. Thus the historical geometry has led to manufacturing constraints that limit the ability to achieve high acoustic fidelity in a simple and reproducible manner.

In one instance a neck of aluminum was described with the frets and fret board machined into an flat surface on the neck to achieve a one piece neck and fret board design to eliminate some of these issues. Open longitudinal channels on the back of the neck were required to reduce the weight and improve sound transfer to the pickups. However, as with other designs, the geometrical shape of the fret board and the back of the neck did not change. The curvature of the front and back were substantially different (US application 2012/0266734 A1). Anodizing was required to provide sufficient surface hardness to avoid the stainless steel strings from wearing out the frets. The anodized surface itself constitutes a material discontinuity within the neck that can distort the resonate properties and result in a sound deadening effect thus negating many of the gains of machining from a single piece of metal.

The magnetic pickups are generally mounted outside the neck, on the body, or are embedded in an open cavity in the body or neck of the guitar to provide additional shielding to reduce unwanted electronic and acoustical noise. Hollow cavities inside the neck have not been exploited for pick-up mounting and shielding. U.S. Pat. No. 4,145,948 describes a carbon fiber neck with a u-shaped channel covered with a fret board and suggests that electronics could be put in the channel but does not describe or show how this is done.

We herein describe a new design for the neck of an electrical stringed instrument best embodied in an electric guitar of all types but also applicable to other stringed musical instruments. The neck is made from a single tube of a non-magnetic steel alloy, preferably stainless steel, with the frets machined into the surface of the tube. The acoustic properties and the ability to achieve and maintain proper tune over time in the presence of environmental extremes of temperature and humidity is superior to previous approaches. The shape of the neck is a radical departure from the prior art and provides ergonomic advantages more suitable to the natural grip of the human hand. This design allows for scalable manufacturing with a high degree of precision and accuracy. It also provides an ideal cavity within the tube to insert electronic magnetic pick-ups of a new design that are naturally shielded from external electrical and acoustic noise. The design is inherently stronger than other approaches resulting in an instrument resistant to mechanical damage even under situations of extreme impact.

SUMMARY OF THE INVENTION

This invention pertains to a neck assembly for an electronic stringed musical instrument that is primarily constructed of a nonmagnetic steel pipe of constant composition throughout, preferably stainless steel that is continuous around the circumference, and has the frets machined into the surface of the pipe. The remaining components to complete the instrument, the tuner, bridge, and strings are all made of similar materials that are closely matched with respect to their tonal characteristic as well as their expansion characteristics under different conditions of temperature and humidity. The electro-magnetic transducers that convert the vibrations of the strings to electrical signals are specially designed to reside inside the neck of the tube.

DESCRIPTION OF DRAWINGS

The following annotations apply to all drawings.

1—Neck made from a pipe or tube
2—Tuner head
3—Strings
4—Body
5—Magnetic pickup
6—Bridge intonation adjustment
7—Bridge base
8—Tuning peg
9—Fret
10—Bobbin
11—Coil
12—Magnet
13—Bobbin half round
14—Magnet half round
15—Potentiometer
16—Radius of curvature-fret board-round
17—Radius of curvature-neck back-round
18—Radius of curvature-fret board-ellipse
19—Radius of curvature-neck back-ellipse
20—Tube extension
21—Base Referring now to FIGS. 1-13 the invention will be described in detail.

Figure 1:
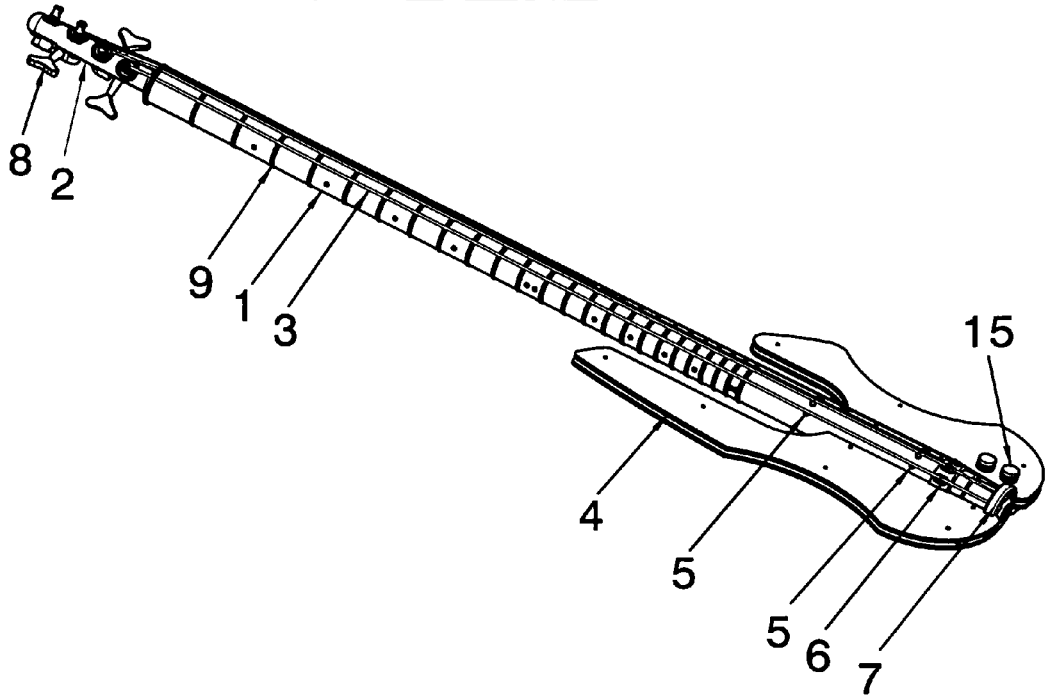
FIG. 1. is a full length view of a four string bass guitar version showing the entire neck assembly having a neck 1 made of non-magnetic steel alloy, preferably stainless steel, with a circular cross section continuous around the circumference. The number of strings is not constrained by this design. Frets 9 are machined into the neck along its length and around its circumference.

The tuner head 2 and the bridge base 7 insert into the neck and are made of the same material as the neck. They are held in place by the tension of the strings 3 which are made of a steel alloy that has magnetic properties and closely approximates the thermal expansion and acoustic properties of the neck. The strings are arrayed parallel to each other along the length of the neck aided by the fact that the adjusting nuts 8 are arrayed around the radius of the neck assembly. In this view the magnets 5 protrude through the tube with the coil windings inside the tube. The base 4 can be readily removed and replaced by other components or left of The potentiometers 15 are shown mounted on the base but they can also be mounted on the neck.

Figure 2:
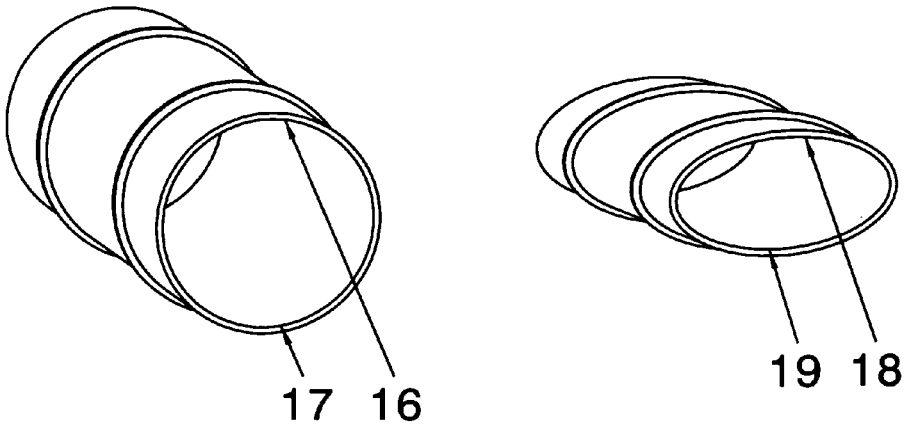

FIG. 2. is a cross section of two different neck geometries, circular and elliptical, both where the pipe is enclosed around the entire circumference. For purposes of description region 16 and 18 is designated as the fret board portion and region 17 and 19 is the back of the neck. It is obvious from this drawing that either surface could serve either purpose. In the case of the circular geometry the drawing makes it obvious that the radius of curvatures of the fret board surface 16 and the opposite side constituting the back of the neck 17 where the palm of the hand rest, are equal. In the case of the elliptical geometry the same principle applies. The fret board surface 18 and the back of the neck 19 have the same radius of curvature. This enhances the ergonomic, acoustical, structural, and manufacturing properties of the neck.

Figure 3:
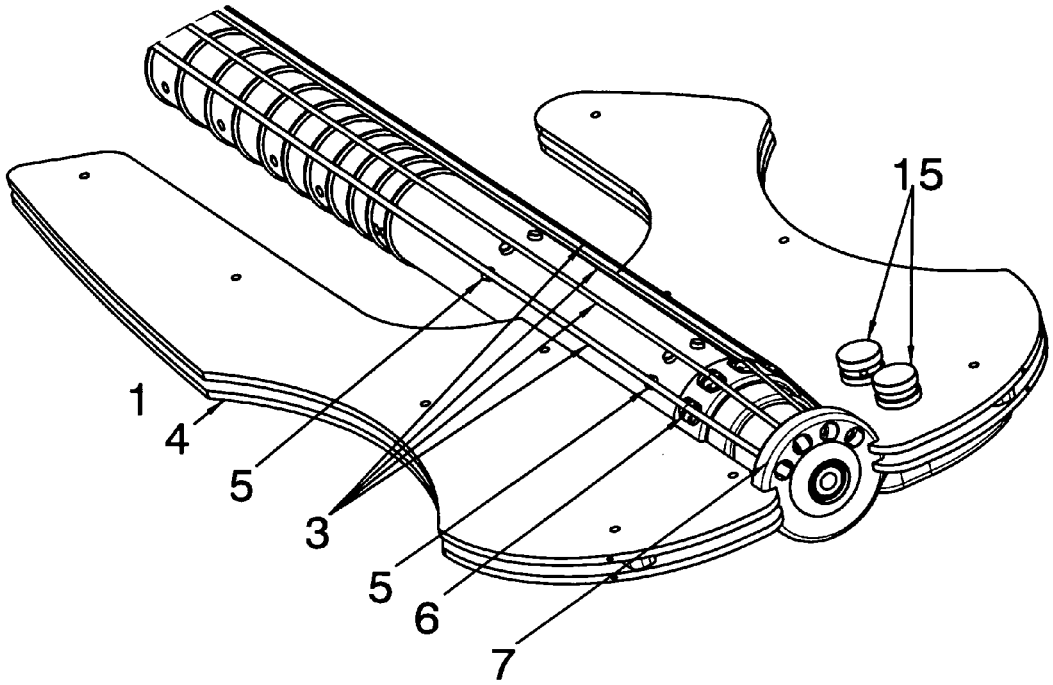

FIG. 3. is a close up view of the bridge section showing a better picture of the parallelism of the strings 3, the location of the permanent magnets radially protruding through the neck 5, and the bridge comprised of the bridge intonation adjustment 6 and the bridge base 7 where the strings are secured by means of balls on the ends of the strings as is typically done. The bridge is made of the same material as the neck to match the thermal expansion properties of the neck 1 and strings 3 and is of hollow construction to match the vibrational characteristics of the neck. It is secured to the neck by the tension of the strings avoiding screws, glues, welds, or brazing that could otherwise distort the vibrational integrity of the neck assembly. The bridge intonation adjusters 6 allow for the height of the strings relative to the neck be adjusted. The bridge base 7 provides a seat for balls at the end of the strings in order to secure them.

Figure 4:
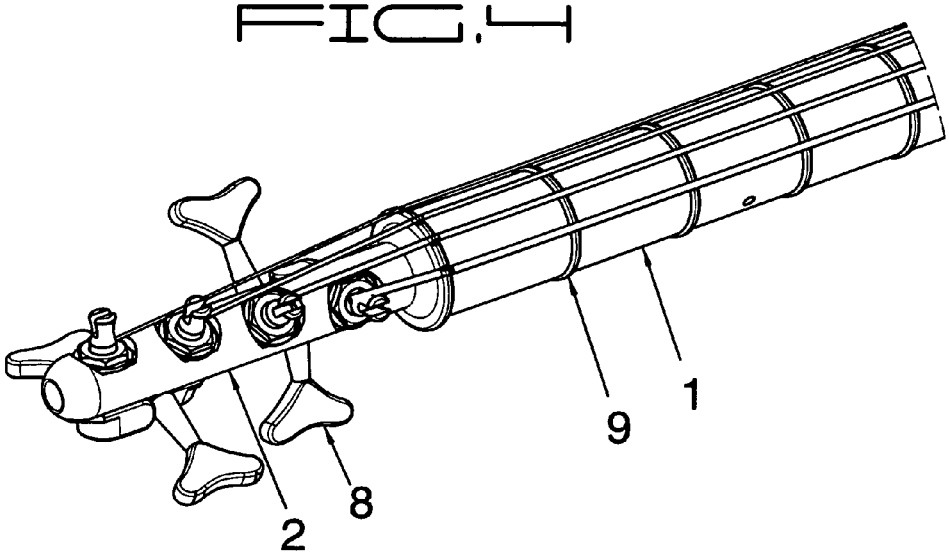

FIG. 4. is a close up view of the tuner head 2 showing the radial array of tuning pegs 8 which allows for the parallelism of the strings to extend from end to end of the instrument and avoid the inclusion of additional bridging elements to reorient the direction of the strings down the neck. As with the lower bridge the tuner head 2 is made of the same material as the neck 1 and is of hollow construction for the same reason. Both of these design elements contribute to the ease of tuning and the ability to maintain a tune. As with the lower bridge the tuner head is secured by the tension of the strings only. No fastening elements are used which could distort the vibrational integrity of the neck assembly.

Figure 5:
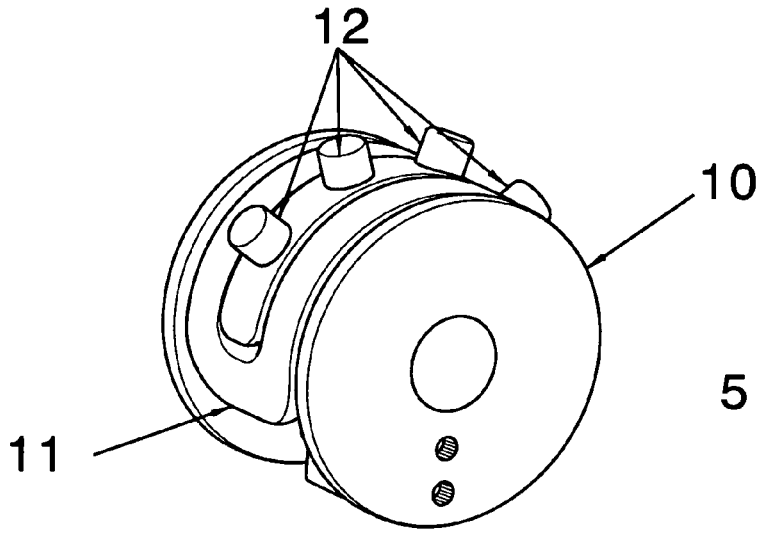
Figure 6:
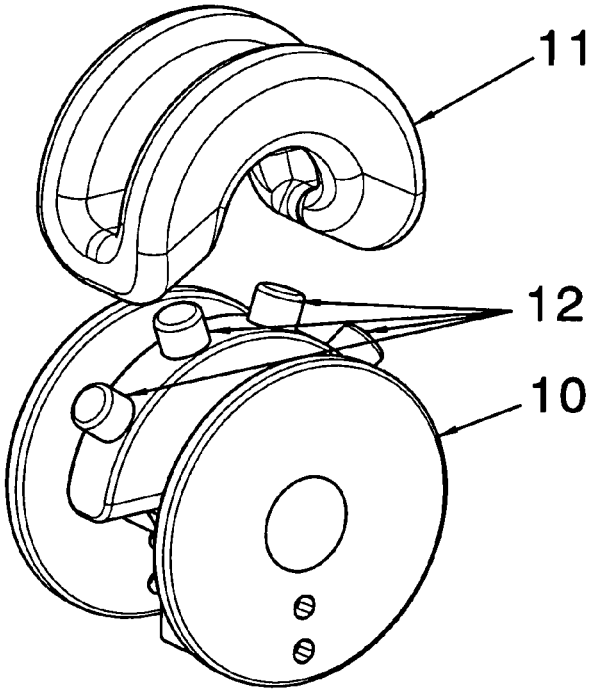

FIG. 5 is a magnetic transducer in the assembled form and FIG. 6 is an exploded view of the same transducer used for generating electrical signals corresponding to vibrations of the strings that are magnetically permeable. This is a drawing of a four stringed instrument as typified by a base guitar but more strings can be accommodated for different types of guitars. This transducer is of a rounded shape to fit inside the neck with the magnets 12 protruding through the wall of the neck. The cylindrical permanent magnets 12 are arranged in a radially array surrounded by a coil of fine copper wire 11. The whole assembly is mounted on a bobbin 10 contoured in a rounded shape to fit inside the neck. The bobbin is made of magnetically and electrically inert material.

Figure 7:
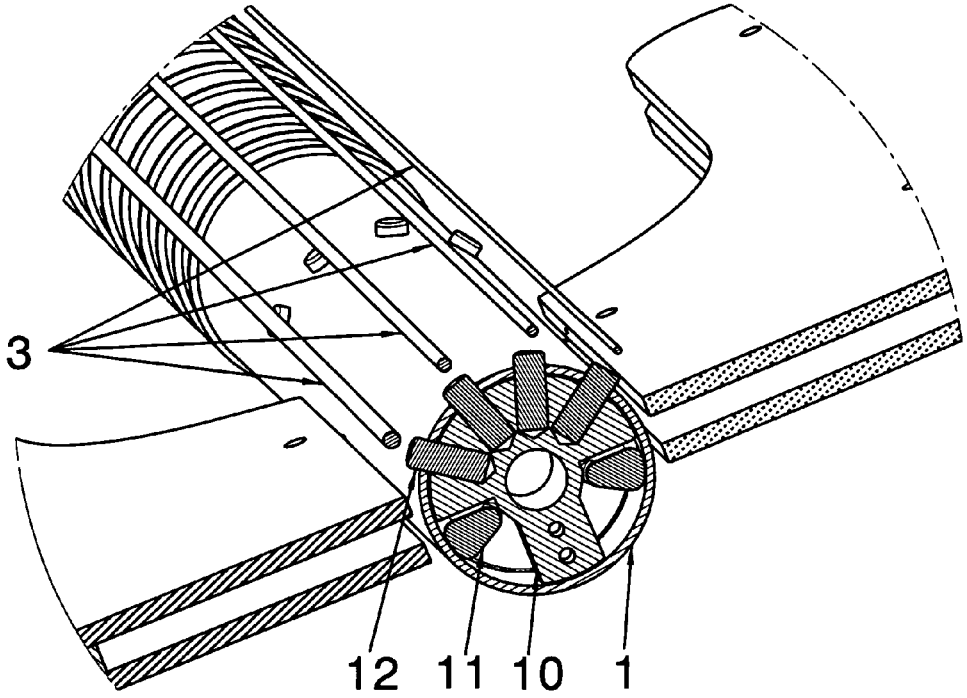
Figure 8:
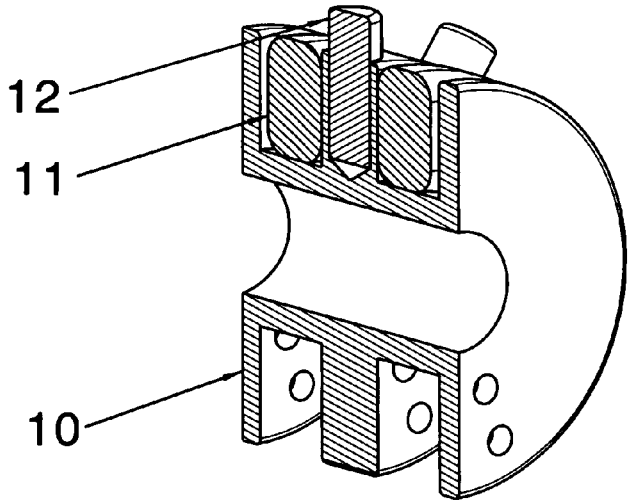

A cross sectional view of the same preferred embodiment is shown in FIGS. 7 and 8 for the same four-string instrument. The four cylindrical magnetic pieces 12 can be seen to be inserted into the holes of the bobbin 10 made of insulating material, preferably Teflon or similar and shaped to hold the coil 11 around the set of four magnets and to provide mechanical structure for the transducer assembly. The coil 11 has preferably 5000 turns, wound with magnetic wire preferably AWG43 copper and shaped radially to conform to the geometry of the bobbin 10 and has the output signal wires exiting through dedicated holes on the side of the bobbin 10. The connector for the cable going to the amplifier is in the end of bridge element. The bobbin 10 is positioned to link with the magnetic flux produced by the magnets 12 and will generate voltages representing changes in magnetic flux, which come from vibrations of strings 3. For that to happen magnets are positioned a short distanced beneath the magnetically permeable strings 3 as shown in FIG. 7, allowing them to modulate the flux intensity in proportion to the magnitude and frequency of vibrations. The voltage induced by the coil 11 is finally delivered to the sound processing equipment. The coil 11 is impregnated with appropriate material to hold its shape in the bobbin and not be subjected to external vibrations. The transducer is designed to fit inside the round neck of the musical instrument and the bobbin diameter is set to match dimensions of the neck's tube. Magnet pieces 12 protrude through the wall of the neck to a region beneath the strings and are inserted into their holding holes after the bobbin 10 is placed inside the tube, which has four openings matching the magnet holes. The magnets 12 shown in FIG. 7 firmly lock the assembly inside the instrument's neck.

Figure 9:
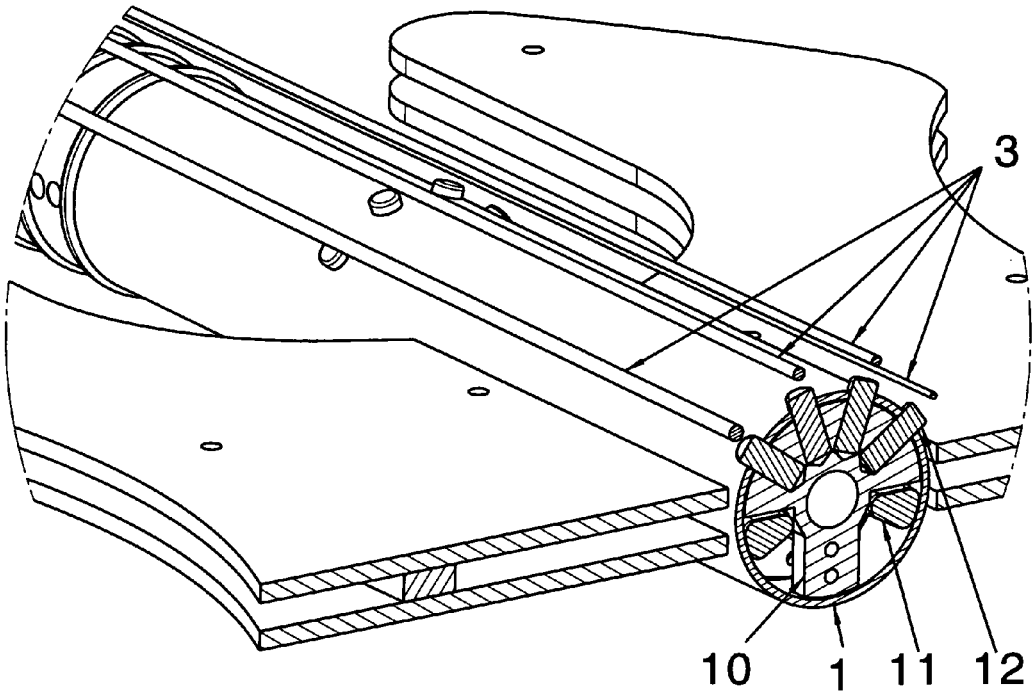

FIG. 9. is a cross sectional views of another embodiment of the magnetic transducer where the radial array of magnets 12 are not protruding through the wall of the neck 1. Because the wall of the neck is made of a steel alloy transparent to magnetic fields, the fields extend beyond the surface of the neck and the vibrating strings induce an electric field in the coils. An advantage of this design is the inside electronics are completely sealed off from the environment.

Figure 10:
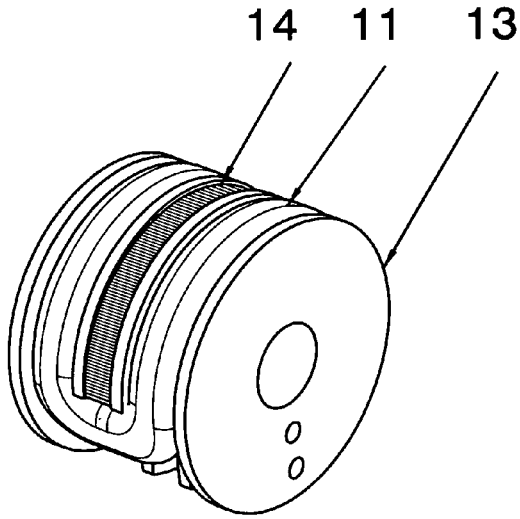

FIG. 10. is another embodiment of the magnetic transducer where the magnetic 14 is formed into a half round arrangement surrounded by the coil 11 and secured in the circular bobbin 13.

Figure 11:
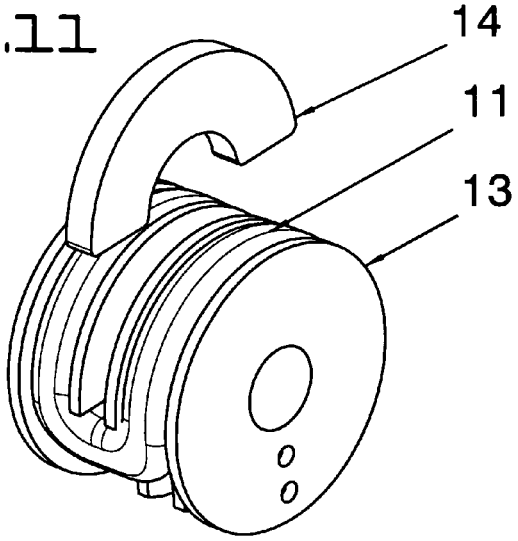

FIG. 11 is an exploded view of the magnetic transducer in FIG. 10 showing the half-round or horseshoe shape of the magnet 14. One advantage of this arrangement is that a magnet of this size and shape will focus a greater magnetic flux into the coils and produce a stronger signal.

Figure 12:
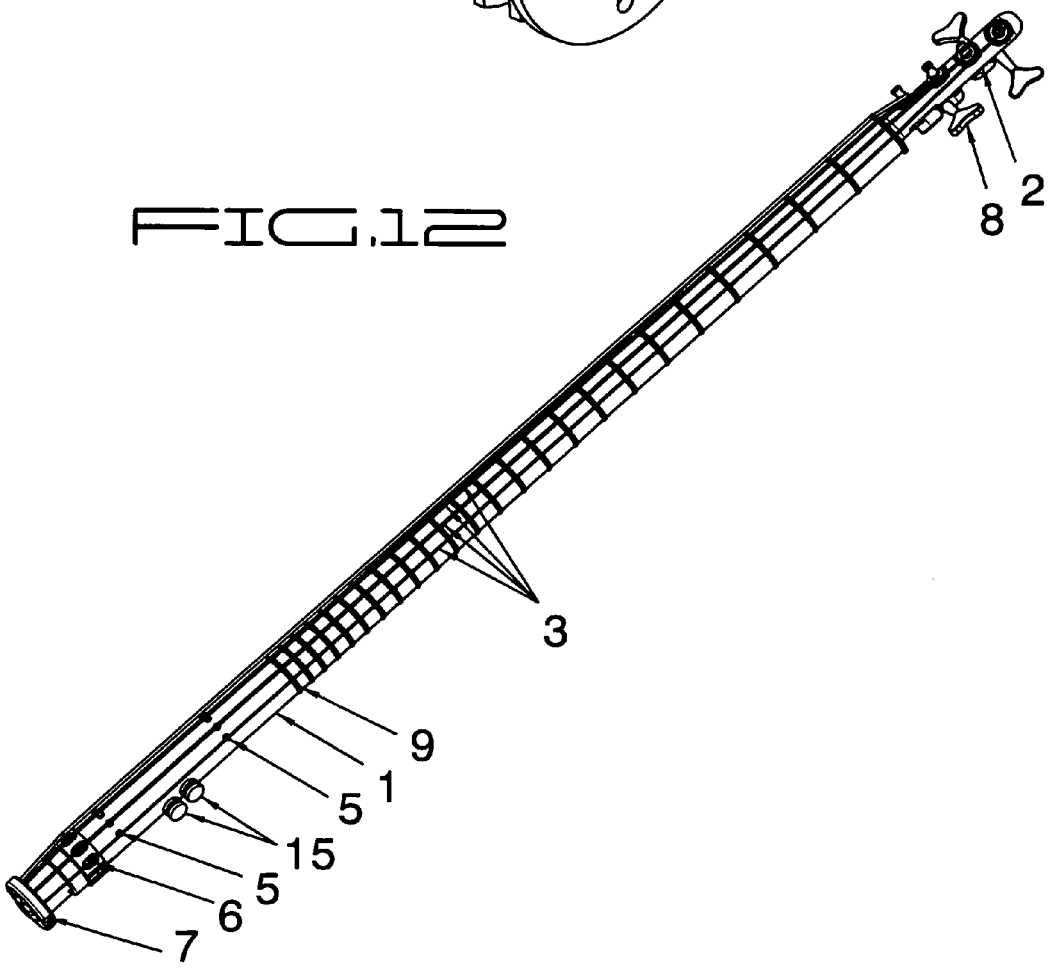

FIG. 12. is a view of a fully functional instrument without a body showing the location of the potentiometers 15. It is mounted on a tube extender 20 and a base plate 21.

Figure 13:
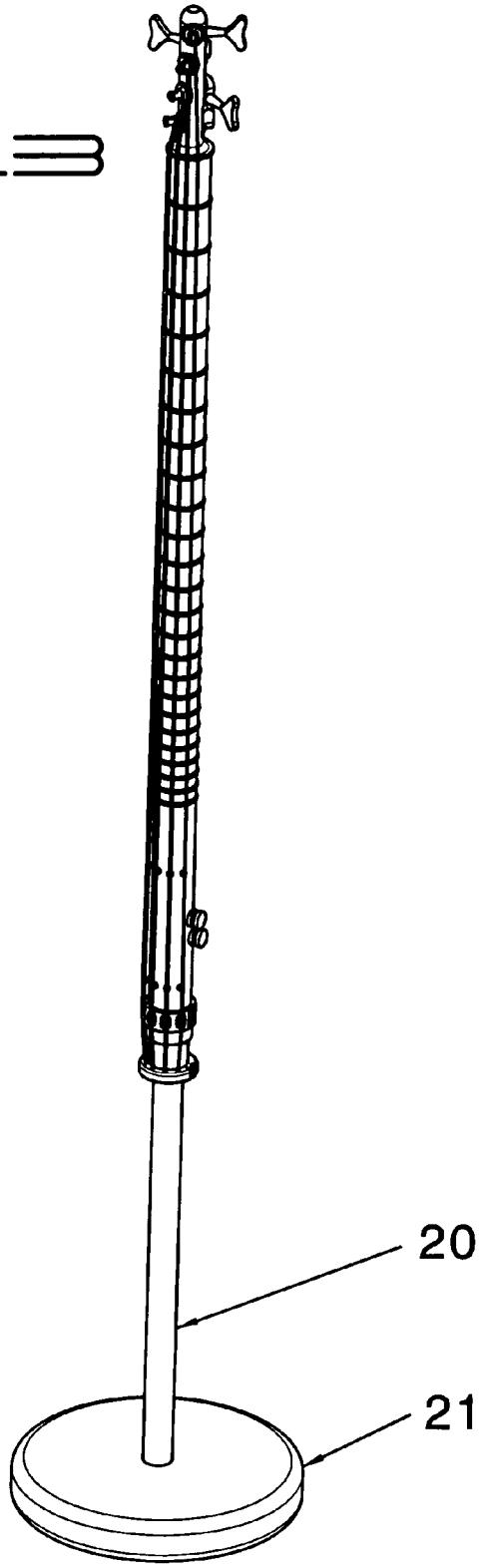

FIG. 13. Is a view of a fully functional instrument without a body mounted on a stand base 17 for vertical playing with a tube extension 16 to raise the instrument to the desired height.

DETAILED DESCRIPTION OF THE INVENTION

For purposes of clarity, the neck assembly of the instrument of this invention is composed of the five following subcomponents that have substantial uniformity of composition.

1. Neck. The neck is the longitudinal pipe located between the tuner and the bridge. The terms pipe and tube are used interchangeably in this description. The frets are machined into the surface of the pipe. The front of the neck is the fret board and the back provides the surface that the palm of the hand rests on. The entire neck is made from the same pipe which is continuous around it's circumference and of a single material composition. The magnetic pick-ups are located inside the neck. The pipe is a non-ferrous steel alloy, preferably stainless steel, so that it has no magnetic properties, is resistant to corrosion, resistant to abrasion from the strings, and has similar resonant properties to the strings which are made of a substantially similar material.
2. Tuner Head. The tuner is a separate part mounted at the top of the neck, is of hollow construction, and made of the same material to match the thermal expansion properties of the neck. Knobs are mounted on the tuner to allow for each string to be individually tensioned. The tension of the strings secures the tuner head and bridge to the neck. No fasteners of bonding agents are used.
3. Bridge. The bridge is mounted on the bottom of the neck, is of hollow construction, and is made of the same material to match the thermal expansion properties of the neck. It is used to secure the bottom of the strings and adjust the distance the strings are from the surface of the neck. The tension of the strings secures the tuner head and bridge to the neck. No fasteners of bonding agents are used.
4. Electronic Pickups. These are composed of wire coils and magnets to transduce the vibrations in the air caused by the strings into electrical signals. They are located inside the neck and are secured to it. They are formed to conform to the internal radius of the neck with the magnets protruding up to, or through, the neck near the back of the strings.
5. Strings. The strings extend from the tuner to the bridge and pass over the magnetic pick-ups. They are made of a material to approximate the thermal expansion properties of the neck, preferably and commonly a steel alloy with some magnetic properties. The number of strings is not constrained by this design. The tension of the strings secures the tuner head and bridge to the neck.

The body of the guitar completes the instrument composed of one or two flanges mounted on either or both sides of the bridge. Although the body can alter the sound of the instrument it is not required for the production of high fidelity sound. Its primary function is for aesthetics and balance. It can be used as a surface for mounting accessory electronics like potentiometers but is not essential for this purpose, accessory electronics can also be mounted on the neck. The neck assembly can be played without the body with no loss of sound fidelity or acoustic properties. Multiple different bodies can be interchanged on the same neck assembly to suit the aesthetic mood of the musician at any particular time.

Referring to the elements described above, this invention involves a novel design for electronic stringed musical instruments with a non-ferrous metallic tubular neck and resonating elements. One preferred embodiment is that of a guitar neck. This design improves stiffness, mechanical and environmental stability, sound quality, tune stability, mechanical accuracy, and ergonomic matching to the natural radius of grip of the human hand. It simplifies the manufacturing process and provides a lower assembly and manufacturing cost of materials. It provides unique tones and harmonics not previously experienced with stringed musical instruments.

There are several unique and advantageous properties of a tubular neck constructed from a pipe made of a non-ferrous steel alloy of uniform composition, enclosed around the circumference as is typical of a pipe structure, where the frets are machined into the tube as a single piece and the electronic pick-ups are mounted inside the tube. All components of the neck assembly are made of similar materials, steel alloys, which contribute to imparting many of the advantageous properties of this design as described in more detail below.

A tubular neck derives its excellent sound from the resonate properties inherent in a structure that is round or elliptical and made from this material. Because of the strength and shape of the material the walls can be thin, typically 1/16 inch or 1.5 mm. The walls and the enclosed cavity serve as an effective sounding board and resonating element adding to the vibrations of the strings providing unique overtones. The uniformity of the cross section of this tubular chamber over its entire length enhances it acoustic properties. The one piece construction with the frets machined into the wall of the tube avoids the disruption of the transmission of the vibrations as would occur when material discontinuities are introduced as a result of the use of bonding agents, screws, welds, and the like when constructing the fret board from multiple components. The use of oxide coatings over aluminum necks is similarly detrimental. Oxides of aluminum are used because they are much harder than the elemental metal and resist wear at contact points such as where the strings meet the frets. Because the properties of the oxides and the base metal are so different they also have different sound transmitting characteristics leading to a deadening effect. Graphite and wood necks also require different hardened materials for the frets to reduce wear leading to the potential for similar distortions. A steel neck with machined frets from the same tube does not suffer from these deficiencies inherent to the other designs.

The situation is exacerbated when dissimilar materials are used for the different components of the neck assembly, i.e. neck, strings, tuner head, and bridge. This is avoided with this approach. The use of alloy steel for the tube, bridge, and tuner head allows for a close matching of the resonate properties of these components and the steel strings. Some slight differences in material properties is required because the neck must not have magnetic properties in order not to interfere with the magnetic pick-ups while the strings must have some magnetic properties in order to inductively couple with the magnetic pick-ups. Compared to other design approaches the acoustic properties of these two most critical elements can be most closely approximated.

It is noted here that other aspects of the design have been implemented to remove extraneous fasteners and connectors that could distort the transport of vibrations throughout the neck assembly. As mentioned earlier, the tuner head and bridge are separate components from the neck. They both have a hollow cavity to approximate the acoustic properties of the neck. They are secured to the neck with the tension supplied by the strings which attach to both of these components. No screws, bolts, welds, or bonding agents are used which could introduce aberrations in the sound.

A hollow tube structure also enhances the sound quality by providing an effective enclosure to shield the magnetic transducers from extraneous electrical and acoustic noise as well as providing a mechanically safe place for protection from the elements and impact damage. The magnetic transducer fits the inside radius of the neck and can be round, elliptical, or arched within a portion of the inner radius of the neck. A magnetic transducer of this type has at least one permanent magnet, at least one coil wound with copper wire surrounding said magnet, and a bobbin of magnetically and electrically inert material of a shape fitted to the inside of the neck and supporting the magnet and coils providing a secure fit. The magnets embedded in the windings can be in the shape of rods arranged in a radial array either protruding through the tube wall to the region behind each string or not penetrating the wall and picking up the string vibrations through the wall of the tube. Strings made of magnetically permeable material will generate electrical signals in the coil when caused to vibrate within the magnetic field of the permanent magnet. With the magnetic transducer inside the neck it is effectively shielded and located in a mechanically secure and protected position.

A consequence of the tubular neck design and the locating and forming of the magnetic pick-ups to the inside of the neck is the development of a novel design for the magnetic transducer. No such round transducer geometry has been proposed to date. In addition to providing superior noise immunity, shielding, and structural integrity, these transducers, located inside the neck, provide excellent sound properties as well. Due to the concentrating effect of a radial array of cylindrical magnets or curved magnets of a horseshoe or donut shape, the inductive field focuses in the pick-up coil providing for more efficient sound generation.

The tubular neck described herein significantly deviates from the prior art in its ergonomic qualities. A geometry where the front and back of the neck provide symmetrical arcs, as is achieved with either a circle or ellipse, offers s natural grip for the human hand. The human hand has evolved over millennia to grasp cylindrical objects such as branches and tools. A flat fret board, or an insufficient radius on the fret board, like flat computer keyboards, can lead to damage to the ligaments of the wrist. If not flat, a typical radius of curvature for current guitar necks is 12 inches (305 mm) or greater. For this design the radius of curvature is ¾ to 1.5 inches (19 to 38 mm). Skilled manipulation of the strings can be achieved faster and more naturally. It is likely that higher levels of skill will be achieved with this design because of its more natural fit to the human hand.

This type of hollow tube structure also provides a variety of mechanical advantages. It has been noted that open channels in a neck will increase strength by imparting the characteristics of a beam structure. A hollow tube maximizes this effect producing the strongest possible structure with the least amount of material. Material reduction translates to weight reduction. The weight of a dense material like steel is compensated for by the structural geometry.

Steel alloys have other mechanical advantages over other non-magnetic metals like aluminum. Although neither will be subject to expansion or contraction due to changing humidity like wood, aluminum will tarnish where stain steel will not. More importantly is the different response to changes in temperature. The thermal conductivity of aluminum is high relative to steel causing it to expand and contract more quickly in response to changes in temperature and to expand and contract to a much greater degree. With steel this effect can be further compensated for by matching the thermal expansion characteristics of the neck and strings by using similar materials. This option does not exist for aluminum, graphite or wooden necked instruments. A steel guitar of this geometry can maintain tune easily and maintain that tune for long periods of time. A stainless steel guitar of this construction, after tuning at room temperature, was shown to maintain its tune after being left in a snow bank for two hours as well as being presented in front of a blast furnace and brought up to a temperature that the human hand could just withstand.

Another aspect of this design, that is a consequence of the tubular neck geometry, is that the strings are arranged in a parallel fashion their entire length, from the bridge of the instrument to the tuner adjustment nuts. Fret boards that are flat or near flat require strings spread away from each other near the bridge so that fingers can gain access. With the strings arranged around a tight radius they can be closer and remain parallel without obstructing the fingers. Faster finger picking and a more comfortable feel can be achieved in this fashion.

At the tuner end conventional designs require that the strings deviate from parallel once again for a different reason. Space must be made for the string tensioning knobs and this can only be achieved by flaring the strings out at wider angles by using an additional bridging element. With the tubular neck this is not necessary, the tensioning knobs are arranged around the radius maintaining the parallelism of the strings from top to bottom and avoiding additional bends. The main consequence of this is ease of tuning and a more stable long lasting tune.

Another advantage of a tubular steel neck with machined frets relates to its manufacturing characteristics. Machining frets and other dimensions into a tubular metallic neck allows for a high degree of mechanical accuracy, precision and reproducibility using machinery that can be readily automated such as center-less grinders and CNC machines. The frets can be machined around the circumference of the neck to maximally simplify manufacture. It has been demonstrated that this arrangement of frets does not inhibit movement of the hand along the back side of the neck. Instruments with identical sound qualities can be produced in mass relatively inexpensively.

All of the advantages herein described are realized within the construction of the neck assembly. The longitudinal structure can be played without loss of its sound qualities, ergonomic properties, or mechanical advantages. The devise can be held free floating or mounted on a base plate on the floor. It is understood by a person skilled in the art that this configuration could be applied to any electronic stringed instrument, including 4, 6, and 12 string guitars.

CITED REFERENCES

Hutchins, Charles W. U.S. Pat. No. 549,966 "Musical Instrument" filed May 11, 1895.

Metal neck with channel enclosed by fret board of different material. Radius on front and back different.

Burke, Glenn F. U.S. Pat. No. 3,072,007 "Guitar Construction" filed Aug. 1, 1960.

Bean, Clifford T. U.S. Pat. No. 3,915,049 "Stringed Musical Instrument with Aluminum Integral Frit" filed Oct. 21, 1974.

Aluminum with open channels. Radius on front and back different.

Fuller, Walter L. U.S. Pat. No. 4,026,178 "Magnetic Pickup for Stringed Musical Instrument" Apr. 11, 1975.

Berardi, Dennis A. U.S. Pat. No. 4,121,492 "Reinforced Neck for Stringed Musical Instruments" filed Jul. 15, 1976.

Truss rod shaped in a "T". No channels. Not metal. Radius on front and back different.

Turner, Warwick A. U.S. Pat. No. 4,145,948 "Graphite Composite Neck for Stringed Musical Instruments" filed Jan. 12, 1978.

Graphite channel enclosed with different material fret board to make semi-circular tube. Radius on front and back different.

Bunker, David D. U.S. Pat. No. 4,201,108 "Electric Stringed Instrument" filed May 22, 1978.

Removable body. Wedge shaped neck No channels. Radius on front and back different.

Martin, James O. U.S. Pat. No. 4,189,974 "Guitar Neck Assembly" filed Sep. 22, 1978.

Stipulates metal but not what kind, Open semi-circular channel, Frets span opening as separate components from neck typically welded. Radius on front and back different.

Brunet, James W. U.S. Pat. No. 4,359,924 "Stringed Instrument Neck Construction" filed Sep. 28, 1981.

Semi-circular metal channel enclosed with fret board of different material. Radius on front and back different.

Cantrell, Charles E. U.S. Pat. No. 5,337,643 "Guitar Neck Apparatus" filed Jun. 28, 1993.

No tube. Convex and concave channels in metal or plastic primarily for ergonomic properties. Made of two or more pieces. Radius on front and back different.

Kunstadt, Robert M. US Pat. App. 20120266734 A1"Guitar Neck" filed Apr. 19, 2011.

Frets machined into aluminum neck. Two different materials because of anodizing. Open channels on back to reduce weight. Radius on front and back different.

The invention claimed is:

1. A neck for an electronic stringed musical instrument composed of a single piece of a non-magnetic steel alloy tube uniform in composition throughout and enclosed around the circumference wherein;

the radius of curvature of the back of the neck and the front fret board of the neck are the same and, the radius of curvature of the back of the neck and the front fret board of the neck are constant along the length and, the frets are machined into the surface of the same uniform piece of metal tube and, the electronic pick-ups are located inside the neck.

2. Apparatus of claim 1 where the neck is of circular cross section.

3. Apparatus of claim 1 where the neck is of elliptical cross section.

4. Apparatus of claim 1 where the strings are made of a steel alloy.

5. Apparatus of claim 1 where the bridge is made of the same material as the neck.

6. Apparatus of claim 1 where the tuner head is made of the same material as the neck.

7. Apparatus of claim 1 where the machined frets encircle the entire circumference of the neck.

8. Apparatus of claim 1 where the machined frets encircle a portion of the circumference of the neck.

9. Apparatus of claim 1 where the coils of the electronic pick-ups are curved to approximate the inner diameter of the neck.

10. Apparatus of claim 1 where the magnets of the electronic pick-ups are curved to approximate the inner diameter of the neck.

11. Apparatus of claim 1 where the magnets inside the coils of the electronic pick-ups are arranged in a radial array in the coil inside the neck.

12. Apparatus of claim 1 where the tensioning elements used for tuning are staggered around the radius of the tubular neck.

13. Apparatus of claim 1 where the strings are arranged parallel to each other along the length of the neck.

14. Apparatus of claim 1 wherein the entire musical instrument is contained in the neck assembly.

* * * * *